United States Patent [19]

Francovitch

[11] Patent Number: 4,631,887

[45] Date of Patent: Dec. 30, 1986

[54] NON-PENETRATING ROOF MEMBRANE ANCHORING SYSTEM

[76] Inventor: Thomas F. Francovitch, 216 Circle Rd., Pasadena, Md. 21122

[21] Appl. No.: 825,132

[22] Filed: Jan. 31, 1986

[51] Int. Cl.[4] ..... B32B 7/08; E04B 1/40; E04D 5/14

[52] U.S. Cl. ..... 52/410; 24/459; 52/222; 52/309.1; 52/506; 52/713; 52/747; 411/373; 411/542; 411/910; 411/930

[58] Field of Search ..... 411/930, 542, 910, 373, 411/377, 375, 82, 258; 24/459, 462; 160/399, 402; 52/309.1, 410, 747, 222, 713, 506

[56] References Cited

U.S. PATENT DOCUMENTS

| | | | |
|---|---|---|---|
| 2,413,916 | 1/1947 | Hallead | 137/613 X |
| 3,247,752 | 4/1966 | Greenleaf et al. | 411/542 |
| 3,426,412 | 2/1969 | Streng et al. | 24/462 X |
| 3,428,614 | 2/1969 | Brownstein | 411/930 X |
| 3,671,371 | 6/1972 | Wolf . | |
| 3,792,510 | 2/1974 | Evett | 24/459 |
| 4,026,183 | 5/1977 | Bart | 411/542 |
| 4,161,854 | 7/1979 | Stelzer | 52/713 X |
| 4,378,616 | 4/1983 | Fischer et al. | 24/459 |
| 4,413,374 | 11/1983 | Ferdinand et al. | 411/373 X |
| 4,455,804 | 6/1984 | Francovitch | 52/410 X |
| 4,502,256 | 3/1985 | Hahn | 52/63 |
| 4,519,175 | 5/1985 | Resan | 52/173 |
| 4,520,606 | 6/1985 | Francovitch | 52/410 |
| 4,531,339 | 7/1985 | Tomaszewski et al. | 52/716 |
| 4,532,744 | 8/1985 | Beneze et al. | 52/222 |
| 4,534,145 | 8/1965 | Yang et al. | 52/222 |

FOREIGN PATENT DOCUMENTS

| | | | |
|---|---|---|---|
| 1050037 | 2/1959 | Fed. Rep. of Germany | 411/373 |
| 2233714 | 1/1974 | Fed. Rep. of Germany . | |
| 2339901 | 2/1975 | Fed. Rep. of Germany . | |
| 1609328 | 4/1975 | Fed. Rep. of Germany . | |
| 2711335 | 9/1978 | Fed. Rep. of Germany . | |
| 2826969 | 1/1980 | Fed. Rep. of Germany . | |
| 3134973 | 12/1983 | Fed. Rep. of Germany . | |
| 1502520 | 10/1967 | France | 411/373 |
| 8502447 | 6/1985 | PCT Int'l Appl. | 411/910 |
| 2095356 | 9/1982 | United Kingdom | 411/910 |
| 483543 | 12/1975 | U.S.S.R. | 411/373 |

*Primary Examiner*—Alfred C. Perham
*Attorney, Agent, or Firm*—Irvin A. Lavine

[57] ABSTRACT

A roof membrane anchoring system is provided of the non-penetrating type, including a base member with an enlarged head carried by an upstanding stem, a disc, and a socket cap which includes a top, depending legs, and feet carried at the bottoms of the legs, the cap being of somewhat resilient material. A clamp is provided for constricting the legs after the socket cap is placed over the head. When uplift forces on the membrane act to deform the disc, it acts against surfaces of the feet of the socket cap, to urge the feet together, thereby providing greater security of the socket cap during periods of high wind velocity. The base member has a passage for insertion therethrough of a fastener, the passage including a quantity of self-curing adhesive material which is cured after insertion of the linear fastener, the adhesive material serving to adhere the linear fastener either to the base member or to a holding element for the linear fastener, or both. In addition, an insert is provided for placement in the passage after the linear fastener is in position, there being interengaging surfaces on the insert member and the wall forming the passage in the base member, to prevent retrograde movement of the linear fastener.

19 Claims, 14 Drawing Figures

FIG-1
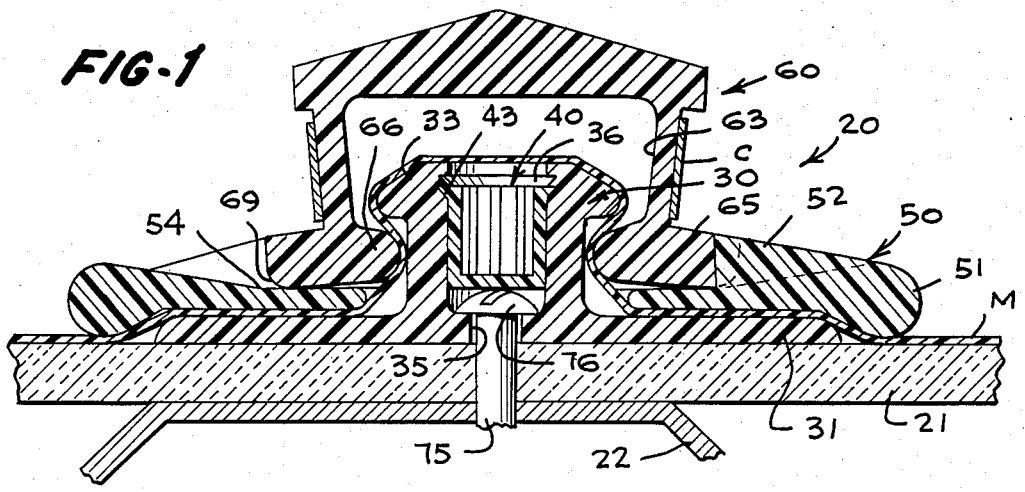
FIG-2
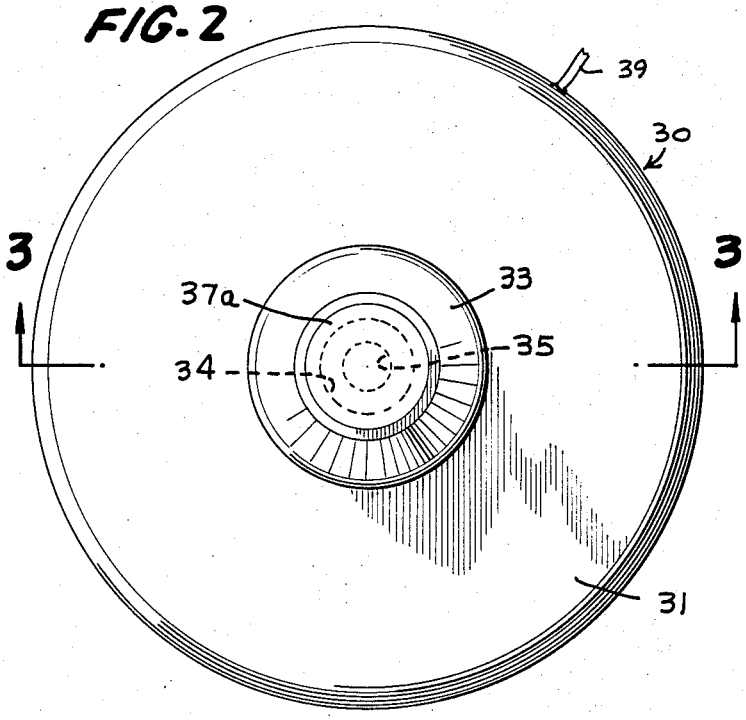
FIG-4
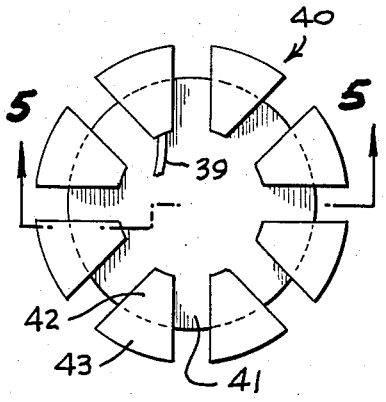
FIG-3
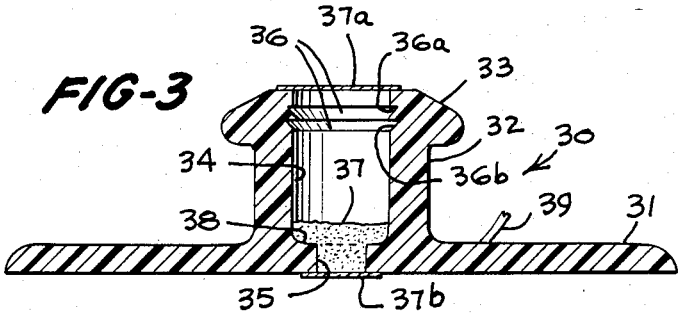
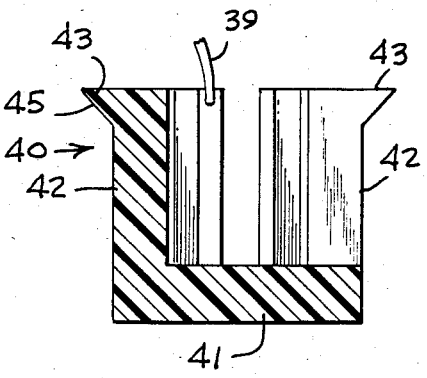
FIG-5

NON-PENETRATING ROOF MEMBRANE ANCHORING SYSTEM

BACKGROUND OF THE INVENTION

The present invention relates to a non-penetrating anchoring system for a roof membrane used to prevent moisture from entering a structure such as a building.

For many years, roofs were of the conventional built-up type, in which multiple layers of material, including a felt material soaked with bitumen, were used. Gravel was imbedded in the bitumen as the upper, exposed layer and was ballast to hold the layers of material down against being lifted by the wind.

In more recent times, an alternate roofing system has gained dominance, which is known as the "single-ply" roofing system. The single-ply roofing system includes the application of a suitable elastomeric membrane over a substrate. The substrate may be either rigid or non-rigid. Rigid substrates include concrete, corrugated steel, gypsum, plywood, and various types of insulation boards. Insulation boards include wood fiber board, perlite board, fiberglass with binder, urethane, urethane with composite of fiberboard perlite or fiberglass, polystyrene, cellular glass and cork board. Non-rigid roofing materials include batt or blanket types of insulation, which is compressible, as by a fastener which penetrates the insulation, or by a membrane which is placed over the insulation.

The membrane may be made of various selected materials, including chlorinated polyethylene, ethylene propylene diene monomer, chlorosyfonated polyethylene, modified bitumen, neoprene, polyisobutylene and polyvinyl chloride. These materials are generally produced in sheets which are transported in rolls having widths which range from about four feet to as much as fifty feet. And the length of the roll may be as much as 150 feet.

The membrane must not only be waterproof but must be prevented from being lifted by wind forces. A waterproof membrane construction is achieved by laying the membrane sheets on the substrate, lapping one over the other, and providing a joint at the overlap which is waterproof and moisture proof. Also, flashing in one form or another is utilized at the edges of the membrane, at pipes, etc.

The retention of the membrane on the roof substrate is achieved in several different ways. One is by a loose laid ballast system, in which small stones are placed over the membrane to hold it down. Another is the partially attached system in which the membrane is secured to the substrate in a distinct grid or geometric pattern. An example of a partially attached system is the "point attachment" construction in which spaced anchors are each secured by a linear fastener to the roof structure. The fastener may penetrate the membrane or may be part of a construction referred to as "non-penetrating". There are also known a totally adhered system, in which the entire undersurface of the membrane is adhered by a suitable adhesive to the substrate, as well as a so called protected membrane roof, which provides for insulation over the membrane.

In the point-attached single-ply anchoring systems there are several problems which must be overcome in both the penetrating and non-penetrating point attachment constructions. In some instances, the anchors have become detached from the roof, and it has now been discovered that this has resulted from a threaded linear fastener having "backed out" from its engagement with a nut or other threaded structure. There has resulted from this a reduction in integrity of the roof, including leakage and an increase in the risk of a roof blow off. Retrograde movement of the linear fastener has been found to be the result of vibrations caused by wind forces on the membrane.

Another problem associated with the non-penetrating construction is that the final locking element of the anchoring system may "pop out" or "snap off", thereby freeing the membrane, and significantly increasing the risk of a roof blow off.

One widely used non-penetrating point attachment construction has a base member with a cone secured to a roof substrate by a linear fastener, a retainer cap with a conical hollow within resilient tines forming a slotted cylindrical wall snapped over the base cone and sandwiching the membrane between it and the base cone, the retainer cap being externally threaded and having an internally threaded cover thereon. This construction has been found to have a number of problems and potential problems associated with it. If the cover is screwed down too tightly onto the retainer cap, the membrane may become pinched between the tines of the retainer cap, and a tear in the membrane could result. The tear may not show up as a leak until snow, ice and rain conditions cause the water level on the roof to reach the tear in the membrane under the retainer cap of the membrane anchor. Also, if the cap is not tightened adequately, it may be easily removed by vandals, and used as a frisbee like toy; or the retainer and cover may possibly snap off as a result of wind uplift forces caused by high winds.

Anchoring systems in the United States are rated by insurance organization(s) for their resistance to wind uplift, that is, whether a particular roof construction will withstand wind forces of a specified amount. Rating categories typically used are I-30, I-60 and I-90, the construction being tested by placing, in the case of a membrane roof construction, a positive air pressure on the underside of the membrane and attachment constructions. For example, to achieve an I-90 rating, 90 pounds per square foot of pressure is thus applied, and the entire roof construction system must hold for a one minute period, at an initial pressure of 30 pounds per square foot, with the pressure increasing, in increments of 15 pounds per square foot, up to and including the 90 pound per square foot pressure. Each interval lasts for a similar one minute period of time. Architects, in designating particular roof constructions, take into consideration the maximum anticipated wind velocity in the geographic location where the roof is to be installed.

At present, point attachment single-ply roof anchoring systems have achieved a maximum of an I-60 rating with anchor constructions placed on three foot centers, that is, one anchor for evey nine square feet of membrane. Where the wind conditions in a particular section of the country require the maximum I-90 rating, the only presently approved membrane securement construction is by a strip attachment, or bar anchor, where a metal bar is placed over the edge of the membrane, spaced four feet apart, and the membrane being lapped, adhered, sealed and seamed. This requires, therefore a very time consuming and expensive construction for obtaining a satisfactory roof at locations where an I-90 rating is required. The ability to utilize non-penetrating fasteners which are more widely spaced is of material benefit. For example, considering a thousand square feet of membrane to be held in place, if the membrane anchors are placed on two foot centers, approximately 250 anchors are required; if the anchors are sufficiently strong that they may be placed on three foot centers, then the number of fasteners required for one thousand square feet is approximately 112. Where an anchor is capable of resisting wind forces so that it achieves a rating of I-90, when placed on four foot centers, only approximately 63 anchors are required. The dimination in the number of anchors, where a stronger anchor is utilized, results in markedly increased efficiencies both in cost of material and in labor costs.

A number of proposals have been made for construction of single-ply roof membrane anchoring systems which are of the non-penetrating type. Among these are that shown in Resan, U.S. Pat. No. 4,519,175, which is the widely used construction above discussed and is known to have a rating of I-60, with point attachment anchors as shown therein placed on three foot centers. Another disclosure of such an anchor system is Hahn, U.S. Pat. No. 4,502,256, a construction which includes in a single structural element a retainer cap, a clamp and a flexible disc extending downwardly and outwardly, formed from a metal spring plate which may be encased in a suitable elastomer or platomer material; the metal spring plate is annular, and is not capable of readily changing the internal diameter, which is necessary in order to provide a contracting socket for cooperation with the mushroom head of a base member.

Also of interest are Francovitch, U.S. Pat. No. 4,520,606, as showing various configurations of non-penetrating anchor systems, German Offenlegungsschrift No. 27 113 35 which provides an integral socket member in the form of an annulus, with an extension portion of small diameter, Offenlegungsschrift No. 28 26 969 which provides a resilient metal wire clamp directly engaging a membrane passed over the head of a base member, Offenlegungsschrift No. 23 39 901 which provides a socket member in the form of a rubber body, having a clamp on the exterior, and German Auslegeschrift No. 16 09 328 which provides a retainer cap in the form of a socket which engages with an undercut portion of a base member, with a membrane held thereby. Also to be noted is Offenlegungsschrift No. 22 33 714

The disclosures in the above-noted documents do not provide for secure systems of the non-penetrating type, which are simple to install, economical, and which would have great resistance to being disassembled by wind uplift forces on the membranes. A further defect in the above-noted constructions is that there is no provision to protect the anchor systems from the linear fasteners which hold the base plate from "backing out" as above described.

SUMMARY OF THE INVENTION

The present invention is directed to a single-ply anchor system of the non-penetrating type, including a base member having a stem and an enlarged head supported on the stem, a socket cap for overlying and engaging the head and including a top, an annular array of spaced legs depending from the top, and re-entrant feet carried by the legs remote from the top, the socket cap being of somewhat resilient material to permit the legs to be contracted so as to reduce the space provided by the re-entrant feet in order that they may lock under the head. A clamp, preferably in the form of a worm-operated hose clamp, of known construction, is provided to contract the legs and feet.

Preferably, a separate disc is provided which is annular, which overlies a membrane placed over the base member, and which is engaged by the undersides of the feet; the disc is relatively thick at its outer periphery, and of somewhat thinner construction at a region adjacent the outer periphery of the feet of the of the socket cap, the feet of the socket cap at their outer regions having surfaces which cooperate with the annular disc, so that if wind forces on the membrane tend to lift the outer region of the disc, any flexure in the disc will be in the region of the disc which is relatively thin, and which is adjacent the outer regions of the feet, so that the feet are urged by the disc in a contracting manner, in order to more securely engage the re-entrant portions of the feet which underlie the head of the base member, and provide greater security of the system against wind uplift forces.

The stem and head have a passage through them, for reception of a headed linear fastener, the passage being provided with a material which hardens upon being disturbed or broken by the passage of a linear fastener, thereby locking the linear fastener in place in order to prevent inadvertent backing out or withdrawal of the linear fastener due, for example, to vibration forces transmitted into the linear fastener from wind forces on the anchor system and/or membrane. Additionally, or alternatively, an insert member is provided, which is placed in the passage in the stem and head after the linear fastener has been inserted, and which has engagement with the stem and head to prevent retrograde movement of the insert member: the lower part of the insert member is adjacent to or in engagement with the head of the linear fastener, and retrograde movement of the linear fastener is thereby limited or prevented. A tether is attached to the base member and insert member to prevent loss during shipment of the insert member. The base member may, in addition, be of sufficient lateral extent outwardly of the stem and head to provide passages for linear fasteners at its periphery, in order that more than one linear fastener may be used to hold the base member to the roof's structure in order to avoid pull out of an anchor system due to disengagement of the linear fastener from the roof structure.

Among the objects of the present invention are the provision of a non-penetrating single-ply membrane anchoring system which is readily applied, provides great resistance to wind uplift forces acting on the membrane, which will avoid back out or retrograde movement of a linear fastener securing the base member to the roof structure, and which provides for greater security of attachment of the base member to the underlying roof structure.

Other objects and many of the attendant advantages of the present invention will be readily understood from a consideration of the following specifications, drawings and claims.

BRIEF DESCRIPTION OF THE DRAWINGS

FIG. 1 is a vertical cross-sectional view through a first embodiment of a roof membrane anchoring structure and substrate, in accordance with the present invention.

FIG. 2 is a top plan view of the base plate of the structure of FIG. 1.

FIG. 3 is a cross-sectional view taken on the line 3—3 of FIG. 2.

FIG. 4 is an enlarged plan view of the fastener locking insert shown in FIG. 1.

FIG. 5 is a vertical cross-sectional view taken on the line 5—5 of FIG. 4.

DESCRIPTION OF THE PREFERRED EMBODIMENTS

Figure 6:
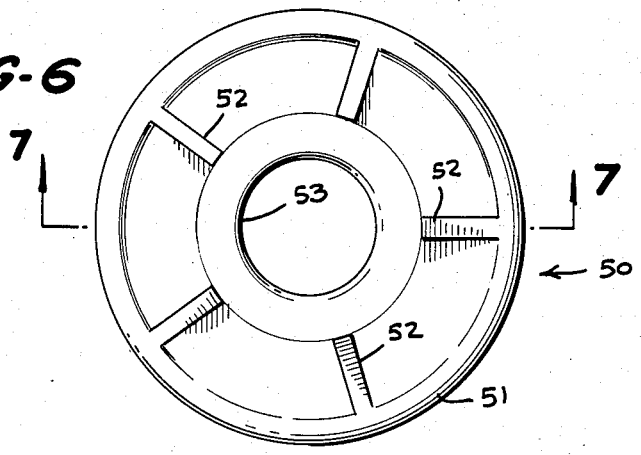
FIG. 6 is a plan view, on a reduced scale, of an annular disc forming a part of the structure of FIG. 1.

Referring now to the drawings, wherein like or corresponding reference numerals are used for like or corresponding parts throughout the several views, there is shown in FIG. 1 a membrane anchoring system 20 in accordance with the present invention, in place on a roof structure including a roof substrate 21, which is preferably of insulating material, and which is supported on a metal deck 22.

The anchoring system 20 comprises a base member 30, over which the membrane M is placed, a disc 50, and a cap socket 60, which is engaged by a clamp C.

Referring now to FIGS. 2 and 3, the base member 30 comprises a flat disc 31 having a stem 32 extending upwardly from it, and supporting an enlarged head 33. A passage 34 extends through the head 33 and stem 32, and a smaller diameter connecting passage 35 extends through the disc 31 providing an upwardly facing shoulder 38 for engagement by the head of a fastener. In the wall defining the passage 34, where it passes through the head 33, are a plurality of grooves 36, each formed by an upper horizontal surface 36*a*, and an inclined surface 36*b*. In addition, a fastener locking material 37 is placed in the passage 35. Material 37, when penetrated by a fastener, will become hard and adhesive, and secure the fastener in its fully set position, and prevent retrograde movement of the fastener. Material 37 may be a self curing adhesive material of the type referred to as cyanoacrylate, such as is disclosed in U.S. Pat. No. 2,413,916. This material changes to an adhesive state when removed from the presence of oxygen, being otherwise in a liquid, and non-adhesive state. The material 37 is retained within the passage 34 by penetrable sheets 37*a* and 37*b*, for example, the remaining space within the passage 34 not occupied by the material 37 being a gas-containing oxygen, such as air. A tether 39 shown partially broken away, extends from disc 31.

Referring now to FIGS. 4 and 5, there may be seen an insert member 40 which is of generally cup-like shape, including a base 41, and a plurality of segmented wall members 42. At their upper ends, the wall members have outwardly extending lips 43, which include a horizontal upper surface 44, and an inclined under-surface 45, the surfaces of 44 and 45 mating with the surfaces 36*a* and 36*b* forming one of the grooves 36 in the wall of passage 34 of base member 30. the material of which the insert member 40 is formed is somewhat resilient, so that the segmented wall members 42 may contract when the insert member 40 is inserted into the passage 34 of the base member 30. The tether 39 is shown in part, and is connected to member 40 to prevent its loss during shipment; tether 39 may be readily removed, if desired, so as not to interfere with its insertion or damage membrane M.

Figure 7:
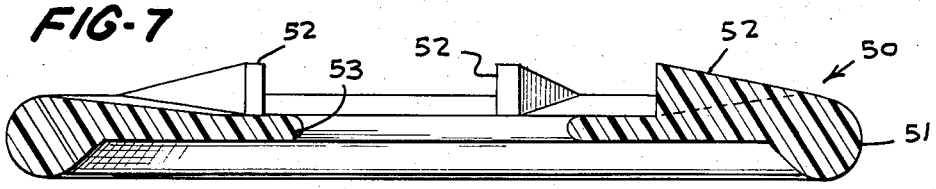
FIG. 7 is a cross-sectional view, on an enlarged scale, taken on the line 7—7 of FIG. 6.

FIGS. 6 and 7 show the annular disc 50 which is provided to resist wind uplift forces transferred from the membrane M. Disc 50 has an enlarged bead 51 at its outer peripheral portion, and a plurality of upstanding ribs 52. The ribs 52 extend only part way along a radius of the annular disc 50, terminating outwardly of the opening 53 formed in the central portion of the disc 50. Outwardly of the portion or region generally designated 54, the disc 50 is of increasing thickness, while inwardly thereof the disc 50 is of uniform thickness. Disc 50 is made of material which is relatively stiff, although it will yield somewhat under wind uplift forces imposed on it by a membrane M subjected to strong wind forces primarily at the region 54.

Figure 8:
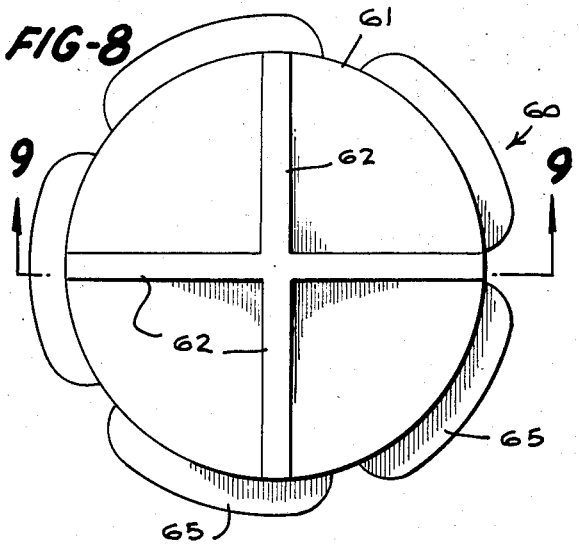
FIG. 8 is a top plan view of the socket cap of the structure of FIG. 1.
Figure 10:
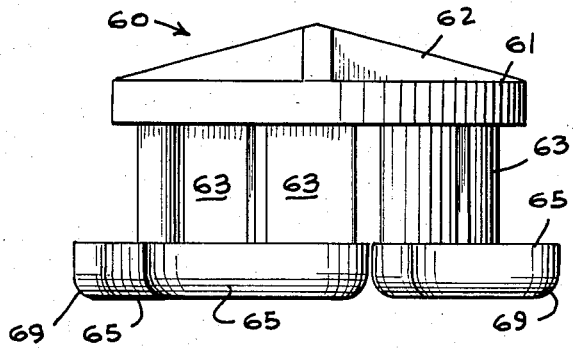
FIG. 10 is an elevational view of the socket cap of FIG. 8.
Figure 9:
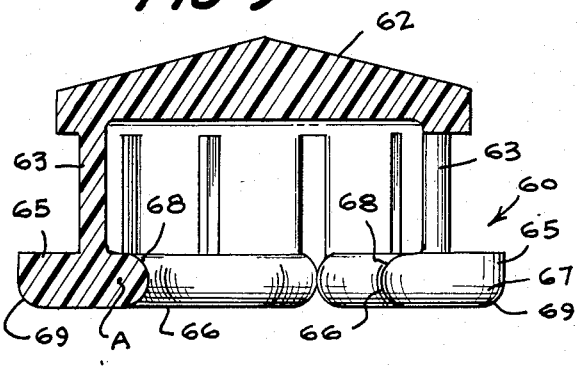
FIG. 9 is a vertical cross-sectional view taken on the line 9—9 of FIG. 8.

FIGS. 8–11 disclose the socket cap 60, there being shown in FIG. 8 a top 61 provided with upstanding ribs 62. As may be seen in FIG. 9, legs 63 depend from the top 61. Referring to FIG. 10, there may be seen a plurality of the legs 63 which are arranged in an annular array, the legs 63 being of peripherally spaced from each other. At their lower ends, the legs 63 carry feet 65 having an inner re-entrant portion 66 and an outwardly extending portion 67. The re-entrant portion 66 is provided with a convex surface 68, extending about an annular axis A. The convex surface 68 provides a smooth, rounded surface for engagement by the membrane M with minimal risk of damage to the membrane M. The outwardly extending portions 67 of the foot 65 has an arcuate, outwardly and downwardly facing surface 69 at its lower region.

Referring again to FIG. 10, there may be seen the top 61 of socket cap 60, the annular array of spaced legs 63, and the feet 65, together with the surfaces 69.

Figure 11:
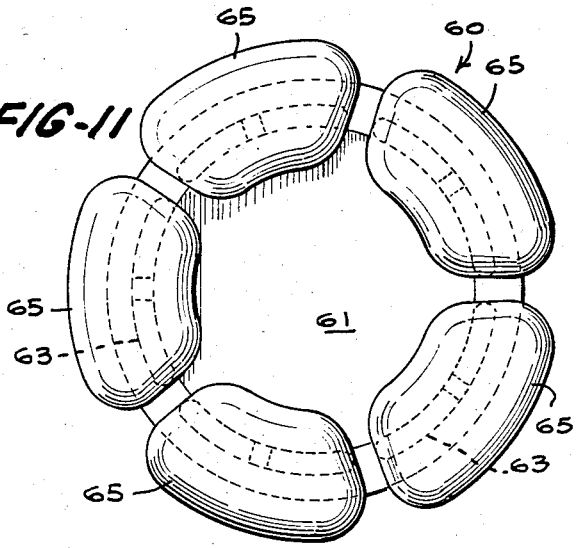
FIG. 11 is a bottom plan view of the socket cap of FIG. 8.

Referring to FIG. 11, there may be seen the top 61, and the feet 65, there being five feet 65 in the embodiment of the invention shown herein. It will be noted that each of the feet 65 is supported by two of the legs 63, and that there is a space between each two adjacent feet 65 which are of similar convex shape so as to avoid damage to the membrane M, should a portion of it be drawn between two adjacent feet 65. The socket cap 60 is made of material which is somewhat yieldable, so that a contracting force applied to the legs 63 will cause legs 63 and the feet 65 carried by them to move inwardly. Such movement is accomplished of course, with the clamp C, as shown in FIG. 1.

Referring again to FIG. 1, there may be seen the base member 30 secured to the roof structure by a linear fastener 75, parts of which are broken away, and which, in a typical installation, would have screw threads thereon. The linear fastener 75 has an enlarged head 76, engaging shoulder 38, and will have been inserted by passing it through the passage 34 in the base member 30. The fastener will have penetrated the penetratable sheets 37*a* and 37*b*, and have been coated with the self-curing adhesive material 37. When the threads of the fastener 75, coated with the self-curing material 37, engage a holding element, such as a nut or a part of the roof's structure, subsequent to its insertion through the base member 30, the self-curing adhesive material 37 will be deprived of oxygen and will become hard and adhesive in nature, thereby adhering the fastener to the holding element therefor. Depending upon the nature and quantity of the material 37 which is provided, it being recognized that other types of material, such as a two-component apoxy may be used, adherence of the fastener 75 may also be to the base member 30. The adherence provided by the adhesive 37 may be of fastener 75 to base member 30, or to such a holding element, or to both. The membrane M overlies the base member 30, extending over the enlarged head 33, and over the disc 31.

The retaining disc 50 is placed over the membrane M, the bead 51 thereof lying outwardly of the disc 31 of the base member 30. The socket cap 60 has the feet 65 in engagement with the upper surface of disc 50, the ribs 52 of disc 50 extending into the spaces between the feet 65. The clamp C, which as above noted is preferably a worm-screw actuated clamp commonly used for connecting resilient hoses to a metal conduit, is placed on and around the legs 63 of the socket cap 60, and when actuated to constrict the clamp C, thereby also urges inwardly the legs 63 and feet 65. The legs 63 are permitted to move inwardly due to the resilient nature of the material of which the socket cap 60 is made, and this movement causes the re-entrant portions 66 to move into interengaging relationship with the head 33 of base member 30, so as to resist disengagement of the socket cap 60 from the base member 30.

The insert member 40 is shown in position in the passage 34, with the flange 43 thereof in a groove 36, with the bottom 41 of insert 40 engaging the top of the head 76 of the linear fastener 75, preventing retrograde movement thereof.

If winds of high velocity pass over the structure shown in FIG. 1, the membrane M will be lifted, except where it is held in position by the anchor system 20, and will exert an upward force on the disc 50. Disc 50 distributes reactive forces over the membrane's surface to reduce the risk of puncturing and tearing the membrane. This upward force will tend to cause the disc 50 to deform, with the outer region thereof raised, and due to the tapering thickness of disc 50, providing it with increased thickness outwardly of the region 54, the disc 50 will flex upwardly, and the surface of the disc adjacent the region 54 will engage the surface 69 of the feet 65, urging the feet 65 inwardly, thereby providing a more secure engagement of socket cap 60 with the base member 30.

The anchor system 20 as shown in FIGS. 1–11 meets I-90 rating tests when placed on four foot centers. Consequently, the anchor system 20 is of great strength, and there is prevention of retrograde movement of linear fastener 75 from the roof due to the insert 40 and/or the locking material 37.

Further, due to the tether 39 connecting the base member 30 with the insert 40, during shipment and preliminary handling, there will be avoided loss or dislocation of the insert member 40.

Figure 12:
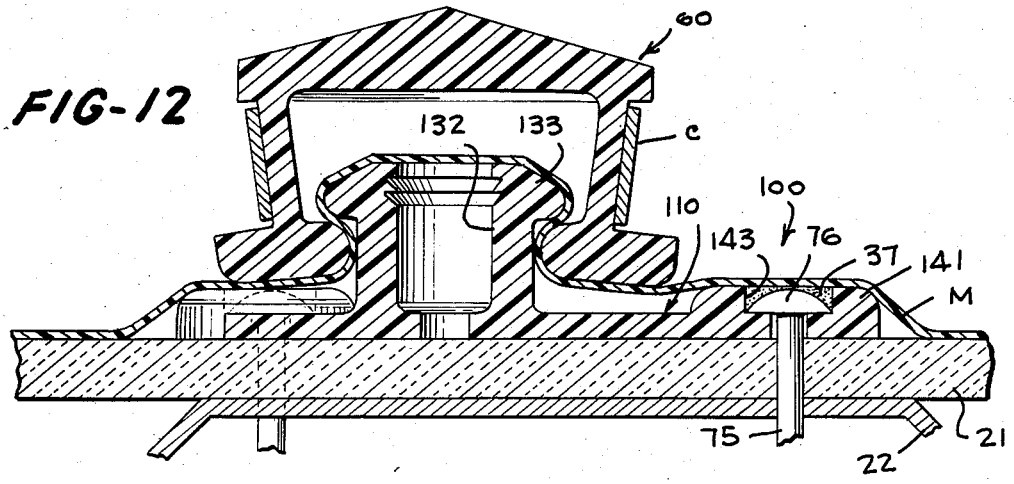
FIG. 12 is a vertical cross-sectional view through a second embodiment of a roof membrane anchoring structure and substrate, in accordance with the present invention.
Figure 13:
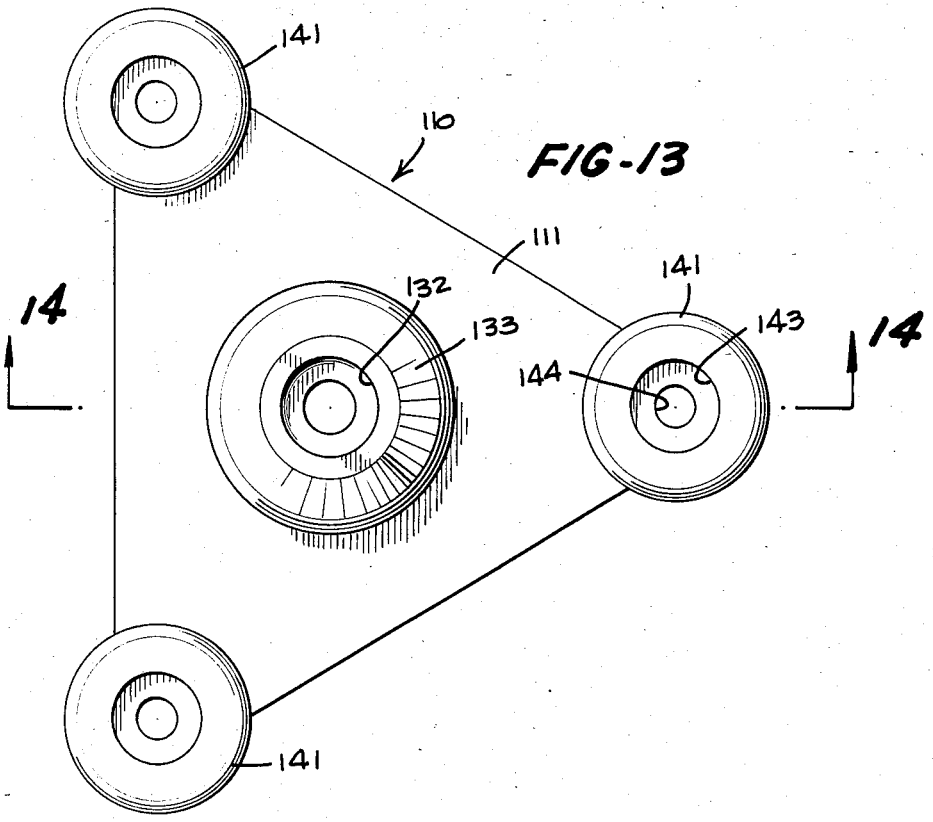
FIG. 13 is a top plan view of the base member of the structure of Fog. 12.
Figure 14:
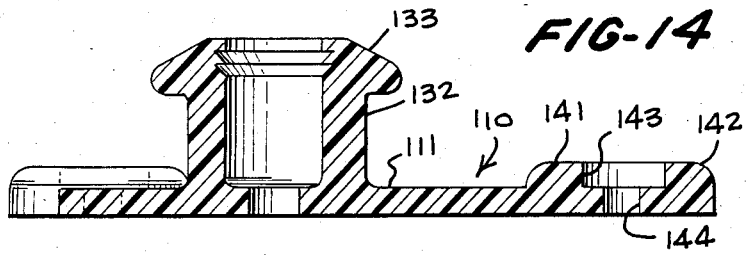
FIG. 14 is a vertical cross-sectional view taken on the line 14—14 of FIG. 13.

Referring now to FIGS. 12, 13 and 14, there is shown a second embodiment of a membrane anchoring system, generally designated 100, the anchoring system 100 being mounted on, for example, a roof substrate 21 which is supported by a metal deck 22. The system 100 includes a base member 110 which comprises a base 111 of generally triangular shape, in the illustrated embodiment, base 111 extending outwardly beyond the stem 132 and head 133. Outwardly of the stem 132 there are provided an annular ridge 141 having the exterior shoulder 142 thereof of arcuate configuration, so as to avoid possibility of damage to a membrane M. A central recess 143 is provided, to which is connected a passage 144 of reduced diameter, for receiving the head 76 and shank of a linear fastener 75, respectively. As is apparent from FIG. 13, there are three such annular ridges 141, one provided in each corner of the triangular base 111. As will be appreciated, the base 111 may not be triangular, but could be of any shape, while providing support for a plurality of annular ridges 141 laterally outwardly of the stem 132 and enlarged head 133.

As shown in FIG. 12, a socket cap 60, membrane M and clamp C is provided, having substantially the same construction as in the embodiments in FIGS. 1–11. Further, the linear fastener 75 may be prevented from retrograde movement, as by the use of material 37.

Although not shown in FIGS. 12–14, a disc 50 may be provided, over the base 111 and membrane M, and beneath the socket cap 60, in the same manner as in the embodiments of FIGS. 1–11.

There has been provided a roof membrane anchoring system which is of the non-penetrating type, and which is extremely resistant to wind loads or uplift forces, being capable of acquiring a rating of I-90, when placed on four foot centers. Accordingly, the membrane anchoring system herein disclosed is of suitable strength for use even in the areas which require the highest wind resistant ratings, and are also economical to install. The anchoring system herein provided is inexpensive, being made of components which may be readily fabricated of known and readily available material. Further, there is provision to prevent retrograde movement of linear fasteners securing the anchoring system to the roof's structure, as well as provision for preventing loss or misplacement of insert members which are provided to prevent such retrograde movement of the linear fasteners.

It will be obvious to one skilled in the art that various changes may be amde without departure from the spirit of the invention, and therefore the invention is not limited to that shown in the drawings, and described in the specification, but only as indicated in the appended claims.

I claim:

1. A non-penetrating roof member anchoring system comprising:

a base member for attachment to a roof substrate comprising an enlarged head, a membrane over said base member, a disc outwardly and transversely of said head, and over said membrane, a socket cap comprising a top overlying said head, an annular array of speed legs depending from said top, re-entrant feet carried by said legs remote from said top for cooperation with said head, means for permitting contraction of said legs and re-entrant feet, the bottoms of said re-entrant feet engaging the top of said disc, and means for contracting said legs to move said re-entrant feet beneath said head for resisting removal of said socket cap from said base member.

2. The non-penetrating roof membrane anchoring system of claim 1, and interengaging means on said disc and said socket cap for urging said re-entrant feet inwardly upon the exertion of upward forces on said disc by wind up lift forces on said membrane.

3. The non-penetrating roof membrane anchoring system of claim 2, said interengaging means comprising the outer portion of said re-entrant feet and the adjacent portion of said disc, said disc having a zone of greatest flexure under uplift loads of said membrane at said adjacent portion thereof.

4. The non-penetrating roof membrane anchoring system of claim 1, said disc being relatively thin at the outer margin of said re-entrant feet and being relatively thick outwardly thereof, whereby the portions of said disc outwardly of said re-entrant feet are subject to being lifted by said membrane, said re-entrant feet at their outer portions having generally downwardly and outwardly facing surfaces engageable by said disc upon lifting thereof by said membrane to thereby urge said re-entrant feet inwardly.

5. The non-penetrating roof membrane anchoring system of claim 1, said re-entrant feet extending inwardly and outwardly from said legs.

6. The non-penetrating roof membrane anchoring system of claim 1, and re-entrant feet having the portions thereof adjacent said stem convex about an annular interal axis.

7. The non-penetrating roof membrane anchoring system of claim 1, said re-entrant feet being preipherally spaced and having theri facing surfaces convexly shaped.

8. The non-penetrating roof membrane anchoring system of claim 1, said head having an axial passage therethrough for insertion of a linear fastener through said base member, and means in said passage for preventing retrograde movement of a fastener in said passage which has been placed therethrough and into a roof substrate.

9. The non-penetrating roof membrane anchoring system of claim 8, said fastener movement preventing means comprising a body of material which hardens subsequent to penetration by a fastener.

10. The non-penetrating roof membrane anchoring system of claim 9, said fastener movement preventing means comprising an insert member in said passage.

11. The non-penetrating roof membrane anchoring system of claim 10, and tether means for securing said insert member to said base member.

12. The non-penetrating roof membrane anchoring system of claim 8, said fastener movement preventing means comprising an insert member in said passage.

13. The non-penetrating roof membrane anchoring system of claim 12, and tether means for seucring said insert member to said base member.

14. The non-penetrating roof membrane anchoring system of claim 12, and means for preventing movement of said insert member towards said top of said cap.

15. The non-penetrating roof membrane anchoring system of claim 14, said last mentioned means comprising detent means.

16. The non-penetrating roof membrane anchoring system of claim 8, said fastener movement preventing means comprising an insert member having a base adjacent but spaced from the bottom of said passage and a wall extending upwardly therefrom, and interlocking means on said wall and in said passage.

17. The non-penetrating roof membrane anchoring system of claim 16, said wall being cylindrical and segmented and said interlocking means comprising protrusions on said wall and grooves in said passage.

18. The non-penetrating roof membrane anchoring system of claim 1, said base member having at least one opening therethrough for a linear fastener.

19. The non-penetrating roof membrane anchoring system of claim 1, said base member having plural openings therethrough remote from said stem for receiving linear fasteners.

* * * * *